US010724339B2

(12) United States Patent
Ponder et al.

(10) Patent No.: US 10,724,339 B2
(45) Date of Patent: Jul. 28, 2020

(54) ROTATIONAL PUMP AND METHOD

(71) Applicants: Andrew Ponder, Houston, TX (US); Daniel Hart, Sugar Land, TX (US); Lambertus Joppe, Tomball, TX (US); Jon-Tore Jorpeland, Stavenger (NO)

(72) Inventors: Andrew Ponder, Houston, TX (US); Daniel Hart, Sugar Land, TX (US); Lambertus Joppe, Tomball, TX (US); Jon-Tore Jorpeland, Stavenger (NO)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 133 days.

(21) Appl. No.: 15/947,568

(22) Filed: Apr. 6, 2018

(65) Prior Publication Data

US 2019/0309602 A1 Oct. 10, 2019

(51) Int. Cl.

| | |
|---|---|
| ***E21B 37/00*** | (2006.01) |
| ***F04C 2/16*** | (2006.01) |
| ***F04C 13/00*** | (2006.01) |
| ***E21B 43/12*** | (2006.01) |
| ***E21B 27/04*** | (2006.01) |

(52) U.S. Cl.

CPC ..... *E21B 37/00* (2013.01); *E21B 27/04* (2013.01); *E21B 43/126* (2013.01); *F04C 2/16* (2013.01); *F04C 13/005* (2013.01)

(58) Field of Classification Search

CPC ..... E21B 37/00; E21B 37/02; E21B 37/04; E21B 37/10; E21B 27/04; E21B 43/126; F04C 13/005; F04C 2/16; F04B 19/12

USPC ..... 415/6, 31, 212.1

See application file for complete search history.

(56) References Cited

U.S. PATENT DOCUMENTS

| | | | |
|---|---|---|---|
| 6,679,328 | B2 | 1/2004 | Davis et al. |
| 2011/0165003 | A1* | 7/2011 | Hofstatter |
| 2012/0118570 | A1* | 5/2012 | Krohn et al. |
| 2012/0118646 | A1* | 5/2012 | Russell et al. |

* cited by examiner

*Primary Examiner* — David Carroll
(74) *Attorney, Agent, or Firm* — Cantor Colburn LLP

(57) ABSTRACT

A downhole pump including a mandrel defining a passageway therein and defining an inlet to the passageway that allows fluid ingress to the passageway from an environment outside of the mandrel and defining an outlet from the passageway that allows fluid egress from the passageway, a blade extending from the mandrel and sized for a close clearance fit in a tubular into which the pump is intended to be used, the blade upon rotation of the mandrel causing a fluid flow regime in a direction across the blade, into the inlet, through the passageway, out of the outlet and back to the blade.

16 Claims, 2 Drawing Sheets

ROTATIONAL PUMP AND METHOD

BACKGROUND

The resource recovery industry often undertakes downhole operations that produce debris. Such debris is often circulated back to surface to be disposed of. The circulation process works and is ubiquitously used but always represents potential issues with accumulated debris where it is an impediment, erosion caused by the flowing debris, among other things. Sometimes, local regulations allow for the deposition of debris in the downhole environment such as in rat holes or to the bottom of the wellbore. This avoids some of the above noted concerns but often takes time for debris to settle to a degree that other operations can resume without the risk of re-entraining debris into the fluid flow stream. Therefore the art is still in need of more efficient alternatives.

SUMMARY

A downhole pump including a mandrel defining a passageway therein and defining an inlet to the passageway that allows fluid ingress to the passageway from an environment outside of the mandrel and defining an outlet from the passageway that allows fluid egress from the passageway, a blade extending from the mandrel and sized for a close clearance fit in a tubular into which the pump is intended to be used, the blade upon rotation of the mandrel causing a fluid flow regime in a direction across the blade, into the inlet, through the passageway, out of the outlet and back to the blade.

A method for moving debris downhole in a well including rotating a pump as in prior embodiment, in a tubular section, dropping debris from a fluid flow pursuant to reduction in flow velocity at a downhole end of the pump, cycling the fluid through the passageway and out the outlet to convey more debris to the downhole end of the pump along the blade.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
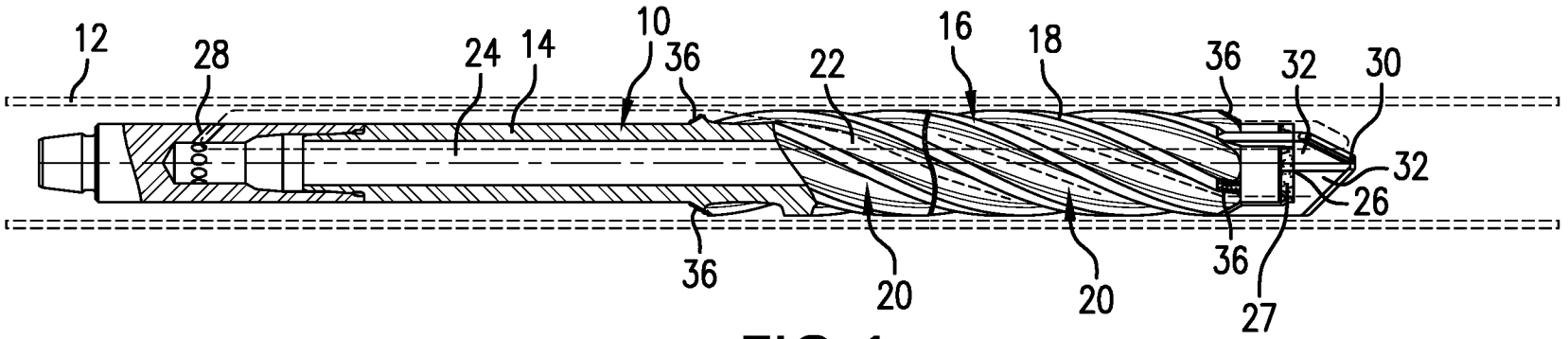
FIG. 1 is a cross section view of a rotary pump as disclosed herein.

Referring to FIG. 1, a rotary pump 10 to cause debris to move downhole is illustrated within a tubular section 12. The tubular section 12 may be a casing, or open hole, for example, and thus may be a part of a much longer tubular form than shown. In some instances the tubular section is a part of a wellbore system. The rotary pump 10 includes a mandrel 14 having a blade 16 disposed thereon. The blade 16 is helical in nature and may be configured as a right hand or a left hand helix. The number of blades 16 may vary for the purpose and be limited only by available space but some embodiments will employ 3-6 blades thereby providing flow flutes 20 that are of a larger dimension than they would be if more blades were used and yet have a relatively large number of working faces 22 to provide for a pumping action.

The blade has an effective diameter that is selected to provide a close clearance fit within the tubular section 12. By "close clearance fit" it is meant that the blade should not have an interference fit with the tubular section 12. The blade should be able to rotate freely in the tubular section 12. Too however, the closer a blade crown 18 of blade 16 is to the tubular section 12, the better the pumping action of pump 10 will be. It will be understood by those of skill in the art that the farther the blade crown 18 is from the tubular section 12, the more the "leakage" will be and the less efficient the pump 10 will be. Accordingly, while a larger gap between the crown 18 and the tubular section is still usable and contemplated, the larger it is, the less the efficiency of pumping action and therefore the smaller that gap is the more efficient the pump 10.

Figure 2:
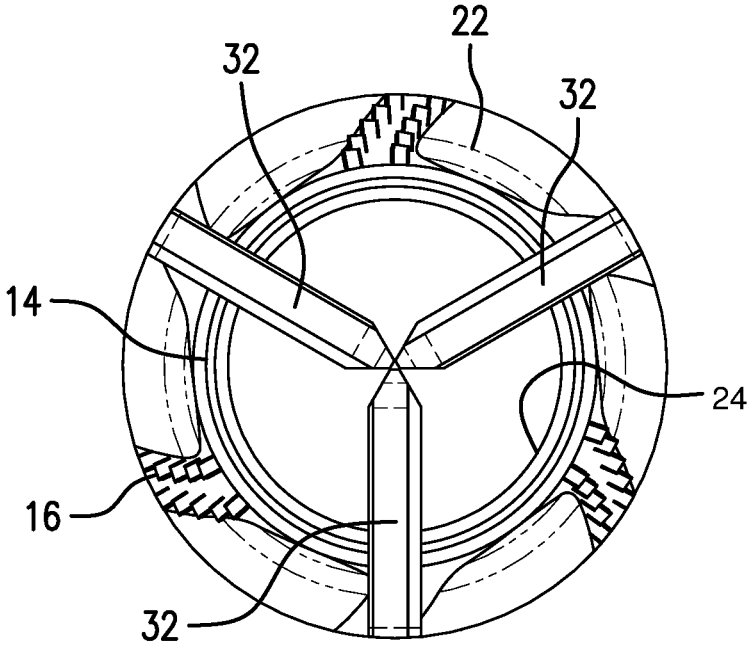
FIG. 2 is an end view of FIG. 1.

The mandrel 14 defines an internal flow passage 24 with an inlet 26 at a downhole end of the pump 10 and an outlet 28 uphole of the inlet 26. Also in embodiments, a "diamond point" 30 is included to help avoid getting hung up on edge surfaces that may exist in the downhole environment while advancing the pump 10 further downhole. Diamond points may have two or more fins 32. In one embodiment three fins 32 are selected as shown in FIG. 2 to provide for hang up avoidance in multiple angular directions while still leaving a sizable open space (120 degrees) between the fins 32 for fluid flow into the inlet 26.

It is desirable that the inlet 26 have a greater flow area than the outlet 28 in order that the outlet 28 controls the flow rate through the pump 10, i.e. the outlet is a choke. Controlling the flow rate is important as it is desirable to have the flow rate at the inlet 26 remain below "lift velocity" for whatever particular debris is being managed at the time. In other words the fluid flow velocity at the inlet 26 should remain at less than what would be required to entrain the debris being managed, thereby ensuring that debris is moved downhole rather than being brought into the pump 10. The exact lift velocity for a given type of debris depends upon the density, shape and size of the debris. If debris were brought into the pump 10, efficiency may be reduced or the pump may become clogged with debris and fail to function. In an alternate embodiment of pump 10, there may optionally be included a filter 27 at the inlet 26, "at" meaning that fluid entering the mandrel 14 through inlet 26 will be filtered fluid so as to prevent the pump from becoming clogged with debris. The filter 27 may be within the mandrel 14, disposed at the end of mandrel 14, etc. so long as for embodiments where a filter is used, the fluid moving beyond the inlet 26 into the mandrel 14 is filtered fluid.

Referring to the outlet 28, while this is illustrated to be angled toward the blades 16, this is not required. Rather the outlet 28 may be angled in any direction including orthogonally to the mandrel 14, or even away from the blades 16. In some iterations, the angularity of the outlet 28 as shown may help the fluid flow through pump 10.

Operational considerations for the blades 16 are blade count, blade geometry, blade lead angle and blade pitch as in all pumps. These parameters may be adjusted for particular applications.

Finally, blades 16 may optionally also include cutting members 36 thereon that will help reduce wear of the blades 16 since debris coming in contact with the cutters will be milled rather than be allowed to damage the blades.

In operation, the pump 10 is rotated in a direction opposite the helix direction so as to cause fluid to flow in a downhole direction between the pump 10 and the tubular section 12.

Rotation may come from surface through a string that is rotated such that no motor or power would be needed in the downhole environment or rotation could come from a rotary prime mover located along the string closer to the pump 16 than the well surface. A rotary prime mover may be a motor that is hydraulically or electrically driven, for example.

Fluid forced below the diamond point 30 will slow down in fluid velocity since it is migrating from a flow flute 20 having relatively narrow dimensions to a larger full bore downhole of the pump 10. As fluid velocity is reduced, its entraining capacity is also reduced making the fluid tend to drop debris that was carried therewith in the downhole direction. The fluid will then enter the inlet 26, be propagated through the passageway 24 to the outlet 28 and then outwardly into an annular space between the pump 10 and the tubular section 12 for another round. That fluid will then pick up debris falling from uphole of the pump 10 and convey it through the flutes 20 to the area below the diamond point 30 as was described in the first sentence of this paragraph. The cycling of fluid through the pump 10 will continue for as long as the pump 10 is rotated in the appropriate direction (dictated by helix direction).

Set forth below are some embodiments of the foregoing disclosure:

Embodiment 1: A downhole pump including a mandrel defining a passageway therein and defining an inlet to the passageway that allows fluid ingress to the passageway from an environment outside of the mandrel and defining an outlet from the passageway that allows fluid egress from the passageway, a blade extending from the mandrel and sized for a close clearance fit in a tubular into which the pump is intended to be used, the blade upon rotation of the mandrel causing a fluid flow regime in a direction across the blade, into the inlet, through the passageway, out of the outlet and back to the blade.

Embodiment 2: The pump as in any prior embodiment, further including a diamond point.

Embodiment 3: The pump as in prior embodiment, wherein the diamond point includes three fins.

Embodiment 4: The pump as in prior embodiment, wherein the inlet defines a flow area larger than the outlet.

Embodiment 5: The pump as in prior embodiment, wherein the outlet restricts fluid velocity at the inlet to less than a lift velocity of a particular debris to be managed.

Embodiment 6: The pump as in prior embodiment, wherein the outlet is angled to expel fluid toward the blade.

Embodiment 7: The pump as in prior embodiment, wherein the outlet is a choke.

Embodiment 8: The pump as in prior embodiment, wherein the blade is helical.

Embodiment 9: The pump as in prior embodiment, wherein the blade is right hand helical.

Embodiment 10: The pump as in prior embodiment, wherein the blade is left hand helical.

Embodiment 11: The pump as in prior embodiment, wherein the blade is six blades defining flow flutes therebetween.

Embodiment 12: The pump as in prior embodiment, wherein the blade includes cutting members at axial ends of the blade.

Embodiment 13: The pump as in prior embodiment, further including a filter at the inlet.

Embodiment 14: The pump as in prior embodiment, wherein the filter is mounted to the mandrel.

Embodiment 15: A method for moving debris downhole in a well including rotating a pump as in prior embodiment, in a tubular section, dropping debris from a fluid flow pursuant to reduction in flow velocity at a downhole end of the pump, cycling the fluid through the passageway and out the outlet to convey more debris to the downhole end of the pump along the blade.

Embodiment 16: The method as in prior embodiment, further including establishing a circulation of the fluid from the blade to the inlet through the passageway to the outlet and back to the blade until rotation is halted.

Embodiment 17: The method as in prior embodiment, wherein a fluid velocity near the inlet is maintained below a lift velocity of the particular debris being managed.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole pump comprising:

a mandrel defining a passageway therein;

an inlet to the passageway that allows fluid ingress to the passageway from an environment outside of the mandrel;

an outlet from the passageway that allows fluid egress from the passageway;

a helical blade extending from the mandrel and sized for a close clearance fit in a separate tubular, and wherein the blade includes cutting members at an axial end of the blade, the blade upon rotation of the mandrel during use causing a fluid flow regime in a direction across the blade, into the inlet, through the passageway, out of the outlet and back to the blade.

2. The pump as claimed in claim 1 further including a diamond point.

3. The pump as claimed in claim 2 wherein the diamond point includes three fins.

4. The pump as claimed in claim 1 wherein the inlet defines a flow area larger than the outlet.

5. The pump as claimed in claim 1 wherein the outlet restricts fluid velocity at the inlet to less than a lift velocity of a particular debris to be managed.

6. The pump as claimed in claim 1 wherein the outlet is angled to expel fluid toward the blade.

7. The pump as claimed in claim 1 wherein the outlet is a choke.

8. The pump as claimed in claim 1 wherein the blade is right hand helical.

9. The pump as claimed in claim 1 wherein the blade is left hand helical.

10. The pump as claimed in claim 1 wherein the blade is six blades defining flow flutes therebetween.

11. The pump as claimed in claim 1 wherein the blade includes cutting members at both axial ends of the blade.

12. The pump as claimed in claim 1 further including a filter at the inlet.

13. The pump as claimed in claim 12 wherein the filter is mounted to the mandrel.

14. A method for moving debris downhole in a well using the downhole pump of claim 1, the method comprising:

rotating the pump in the tubular;

dropping debris from a fluid of the fluid flow regime pursuant to reduction in flow velocity at a downhole end of the pump;

cycling the fluid through the passageway and out the outlet to convey more debris to the downhole end of the pump along the blade.

15. The method as claimed in claim 14 further including establishing a circulation of the fluid from the blade to the inlet through the passageway to the outlet and back to the blade until rotation is halted.

16. The method as claimed in claim 14 wherein a fluid velocity adjacent the inlet is maintained below a lift velocity of the particular debris being managed.

* * * * *